United States Patent [19]

Miyazaki et al.

[11] Patent Number: 4,604,872

[45] Date of Patent: Aug. 12, 1986

[54] HEAT PUMP TYPE AIR CONDITIONING APPARATUS HAVING A CONTROLLED VARIABLE CAPACITY COMPRESSOR

[75] Inventors: Koichi Miyazaki, Shizuoka; Masaya Yamazaki, Fuji, both of Japan

[73] Assignee: Kabushiki Kaisha Toshiba, Kawasaki, Japan

[21] Appl. No.: 695,254

[22] Filed: Jan. 25, 1985

[30] Foreign Application Priority Data

Feb. 3, 1984 [JP] Japan ..... 59-17088

[51] Int. Cl.[4] ..... F25D 21/06

[52] U.S. Cl. ..... 62/156; 62/160; 62/228.4; 62/157

[58] Field of Search ..... 62/160, 156, 157, 158, 62/228.4, 228.5, 215, 155, 278, 234, 196.1, 196.2, 196.3, 196.4

[56] References Cited

U.S. PATENT DOCUMENTS 4,209,994 7/1980 Mueller et al. ..... 62/156 X
4,269,261 5/1981 Kountz et al. ..... 62/160 X
4,480,443 11/1984 Nishi et al. ..... 62/228.5 X

FOREIGN PATENT DOCUMENTS 52-39172 10/1977 Japan .
0115236 7/1983 Japan ..... 62/160

*Primary Examiner*—Harry Tanner
*Attorney, Agent, or Firm*—Oblon, Fisher, Spivak, McClelland & Maier

[57] ABSTRACT

A heat pump type air conditioning apparatus having a variable capacity compressor, wherein the compressor capacity is changed in accordance with the load of the air conditioning apparatus. The revolutions of the compressor, i.e., the compressor capacity, is controlled to be low when heating cycle restarts after finishing a defrosting cycle.

5 Claims, 3 Drawing Figures

HEAT PUMP TYPE AIR CONDITIONING APPARATUS HAVING A CONTROLLED VARIABLE CAPACITY COMPRESSOR

BACKGROUND OF THE INVENTION

1. Field of the Invention

This invention relates to heat pump type air conditioning apparatus having a variable capacity compressor, and more particulaly to such an apparatus having a control device for preventing compressor lock upon restart after completing a defrosting cycle.

2. Description of the Prior Art

Conventionally, after prolonged heating cycle usage, the efficiency of the heat pump type air conditioning apparatus is lowered due to the outdoor heat exchanger becoming coated with frost or ice. Then, in order to defrost the accumulated frost or ice, the apparatus changes from a heating cycle to a cooling cycle. During such defrosting, the low temperature refrigerant flows into the indoor heat exchanger and the room temperature decreases. As a result, it is necessary to shorten the defrosting time in order to decrease the resulting room temperature drop.

In order to shorten the defrosting time, it is necessary to operate the compressor at high capacity during defrosting. However, this approach has the following problems.

At the end of the defrosting time, the refrigerant in the outdoor heat exchanger is in a liquid state under high pressure. Therefore when the heating cycle resumes operation after defrosting, the liquid refrigerant in the outdoor heat exchanger flows into the compressor and the refrigerant in the compressor dissolves into the lubricant which is used to lubricate the moving or rotating parts of the compressor. As a result, the lubricating performance of the lubricant decreases.

Moreover, the compressor must be operated at high capacity because the room temperature is low when the heating cycle restarts. When the compressor is operated at high revolutions under such conditions, the compressor cannot operate smoothly and in an extreme case the compressor locks and cease operation altogether.

SUMMARY OF THE INVENTION

Accordingly, it is an object of this invention to provide an improved heat pump type air conditioning apparatus.

Another object of this invention is to provide an improved variable capacity compressor.

A further object of the present invention is to provide novel means for controlling a variable capacity compressor.

These and other objects are achieved according to the invention by providing a heat pump type air conditioning apparatus including a means for controlling the capacity of a variable capacity heat pump compressor, wherein the capacity is set to be low when the heating cycle begins after defrosting operation is completed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
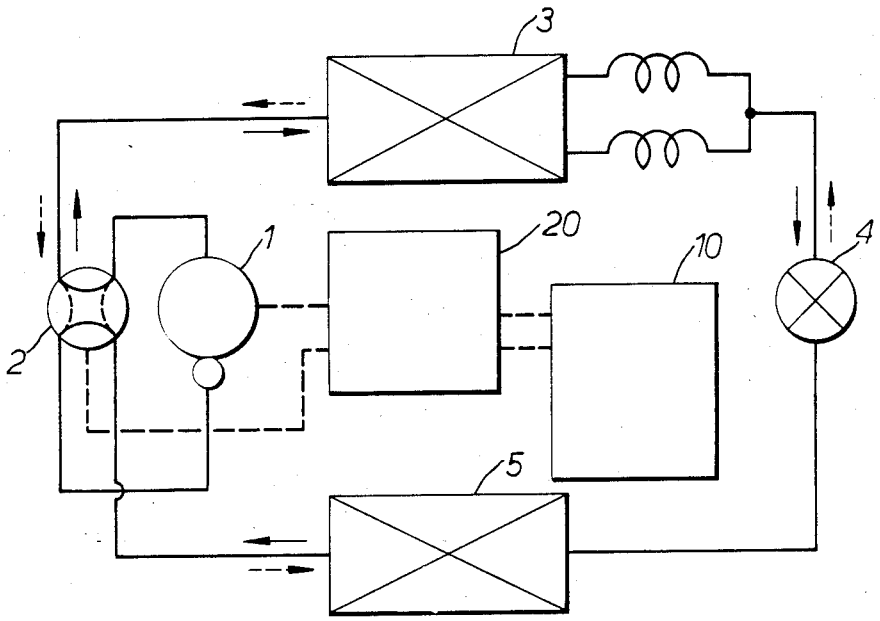
FIG. 1 is a block diagram of the apparatus according to the invention illustrating the refrigeration cycle according to the present invention.

Referring now to the drawings, wherein like reference numerals designate identical or corresponding parts throughout the several views, and more particularly to FIG. 1, thereof a general outline of the refrigeration cycle of the apparatus of the invention is illustrated.

Figure 2:
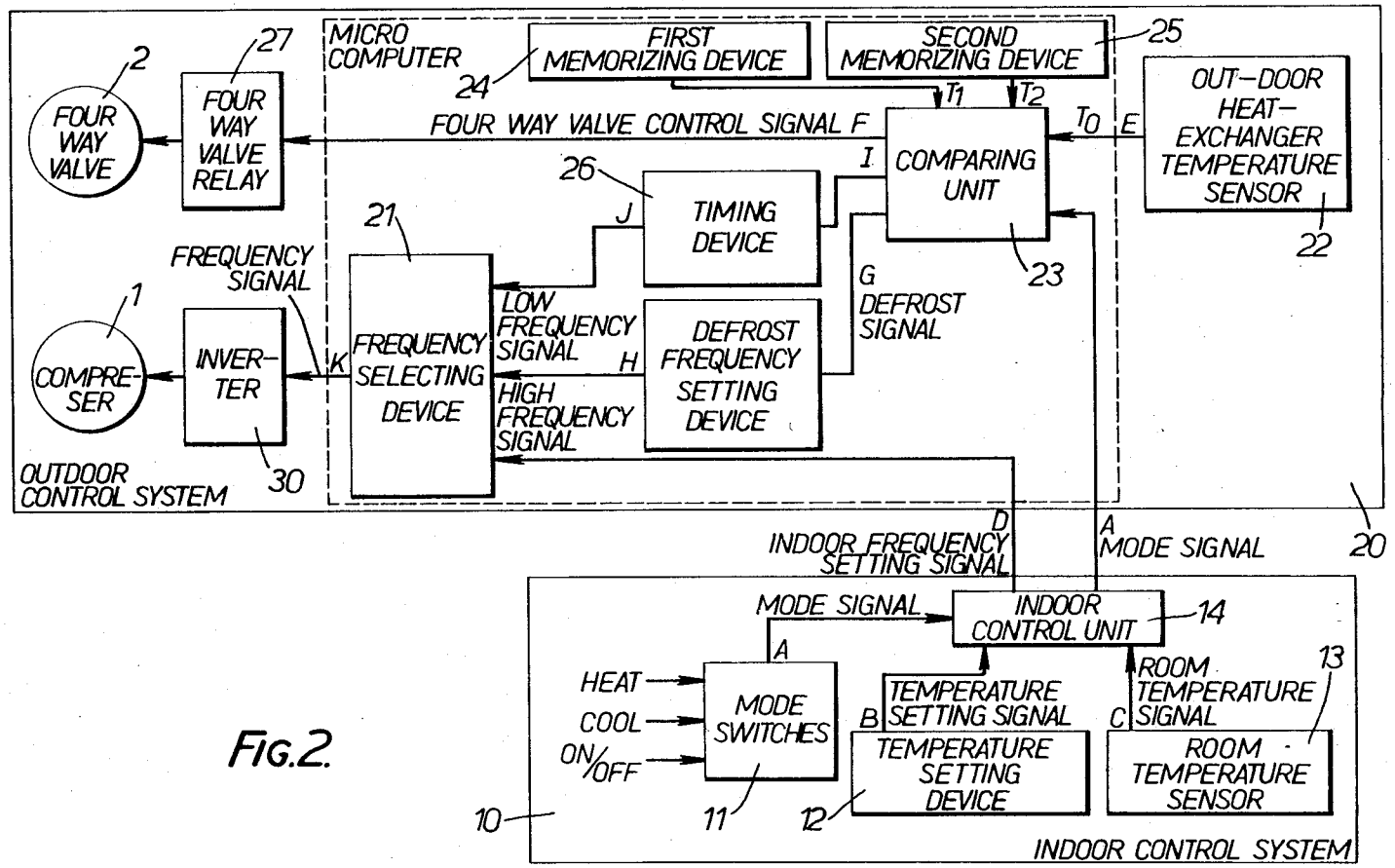
FIG. 2 is a block diagram illustrating in more detail one embodiment of the apparatus of the invention.

The apparatus includes a variable capacity compressor driven by an inverter 30, as shown in FIG. 2, an outdoor heat exchanger 3, an expansion valve 4, and an indoor heat exchanger 5, interconnected through a four way valve 2 and conduits.

When the refrigerant of the apparatus is in the heating cycle, the refrigerant flow is represented by the broken single-dotted line arrow shown in FIG. 1. The refrigerant is discharged from the compressor 1 and passes through the four way valve 2, the indoor heat exchanger 5, the expansion valve 4, the outdoor heat exchanger 3, the four way valve 2 and returns to the compressor 1.

In this case the indoor heat exchanger 5 operates as a condenser, and the outdoor heat exchanger 3 as an evaporator.

When the air conditioner operates in the cooling and defrosting cycle, the refrigerant flow is denoted by the arrow shown in FIG. 1. Then, the refrigerant flow of the circuit is in reverse, namely, the refrigerant outputted from the compressor 1 passes through the four way valve 2, the outdoor heat exchanger 3, the expansion valve 4, the indoor heat exchanger 5, the four way valve 2 and returns to the compressor 1.

In this case the indoor heat exchanger 5 operates as the evaporator and the outdoor heat exchanger 3 operates as the condenser.

FIG. 2 is a block diagram of one embodiment of the invention.

The variable capacity compressor 1 is driven by an inverter 30, which generates a variable frequency signal in accordance with the load of the heat pump type air conditioning apparatus. In other words, if the discrepancy between the desired temperature and the actual temperature is large the inverter 30 generates a high frequency signal, and vice versa.

The indoor control system 10 includes mode switches 11, a temperature setting device 12, a room temperature sensor 13 and an indoor control unit 14.

The mode switches 11 are operated by the user to select either the heating mode or the cooling mode of operation. The mode switches 11 produce a heating or cooling mode signal A to the indoor control unit 14.

The temperature setting device 12 produces an electrical signal B in proportion to a set value of room temperature which is set by the user.

The room temperature sensor 13 produces an electrical signal C which is proportional to the present actual measured temperature in the conditional space where the temperature is to be controlled.

These signal B and C are provided to the indoor control unit 14. The indoor control unit 14 produces an indoor frequency setting signal D which is proportional to the difference between the actual temperature and the user-selected set temperature. The indoor frequency setting signal D is supplied to the frequency selecting device 21 included in the outdoor control system 20, and defines the output frequency of the inverter 30.

OUTDOOR CONTROL SYSTEM

The outdoor control system 20 is microcomputer controlled and is mainly divided into two parts. The first part of the system controls the output frequency of the inverter 30. The second part of the system controls and detects the defrosting mode of operation.

An outdoor heat exchanger temperature sensor 22 is attached to the outdoor heat exchanger 3, and produces an electrical signal E which is proportional to the temperature nearby the outdoor heat exchanger 3. The signal E from the sensor 22 is supplied to the comparing unit 23.

Two memory devices 24, 25 are connected to the comparing unit 23. The first memory device 24 sets a first temperature value $T_1$ which is the lower threshold of the heating operation. The second memory device 25 sets a second temperature $T_2$ which is the upper threshold of the defrosting operation. The comparing unit 23 receives mode signal A from the indoor control 14 and controls the position of the four way valve 2 to the position shown in FIG. 1 when the mode signal A is cooling signal, and controls the position of the valve 2 to the broken single-dotted position when mode signal A provides a heating signal.

The comparing unit 23 decides on entry into the defrosting mode when the temperature value $T_0$ of the outdoor heat exchanger is lower than the first temperature value $T_1$, and produces a logic "0" signal F which changes the position of the four way valve 2. Therefore, the heating cycle changes to the defrosting cycle in order to defrost any accumulated frost or ice. At the same time, an electrical signal G is generated by the comparing unit 23 and applied to the defrost frequency setting device 25. The defrost frequency setting device 25 generates an electric signal H which requests a predetermined high frequency $f_H$ to be set by the frequency selecting device 21. The defrost frequency signal H is fed during the time of defrosting. While the defrosting mode of operation is continuing, the comparing unit 22 compares the second temperature value $T_2$ with the temperature value $T_0$, represented by the signal E, of the outdoor heat exchanger 3, and decides that the defrosting cycle is finished when the temperature value $T_0$ of the outdoor heat exchanger 3 is higher than the second temperature value $T_2$.

At the end of the defrosting cycle, the comparing unit 23 produces a logic "1" signal F which changes the position of the four way valve 2 and generates another electrical signal I which is supplied to the timing device 26.

The timing device 26 begins to count time, as soon as the electric signal I is received. The timing device 26 generates a predetermined low frequency $f_L$ signal J during a time interval upon receiving the signal I. The low frequency $f_L$ signal J is supplied to the frequency selecting device 21.

When the frequency selecting device 21 receives only the indoor frequency signal D from indoor control unit 14, the frequency selecting device 21 generates a frequency signal K which is based on the indoor frequency signal D to the inverter 30.

When the frequency selecting device 21 receives the defrosting frequency signal H, the frequency selecting device 21 selects a predetermined high frequency $f_H$ signal H, and produces and applies frequency signal K which is based on the high frequency signal H to the inverter 30.

When the frequency selecting device 21 receives the low frequency $f_L$ signal J, the frequency selecting device 21 selects the low frequency $f_L$ signal J and produces and applies frequency signal K which is based on the low frequency $f_L$ signal J to the inverter 30.

The inverter 30 generates a three phase alternating current in correspondence with the frequency signal K supplied by the frequency selecting device 21. The alternating current generated by the inverter 30 is supplied to the compressor 1.

Therefore, the motor speed of the compressor 1 is proportional to the frequency of the alternating current supplied by the inverter 30. The capacity of the compressor 1 varies in proportion to the compressor motor speed.

OPERATION

Figure 3:
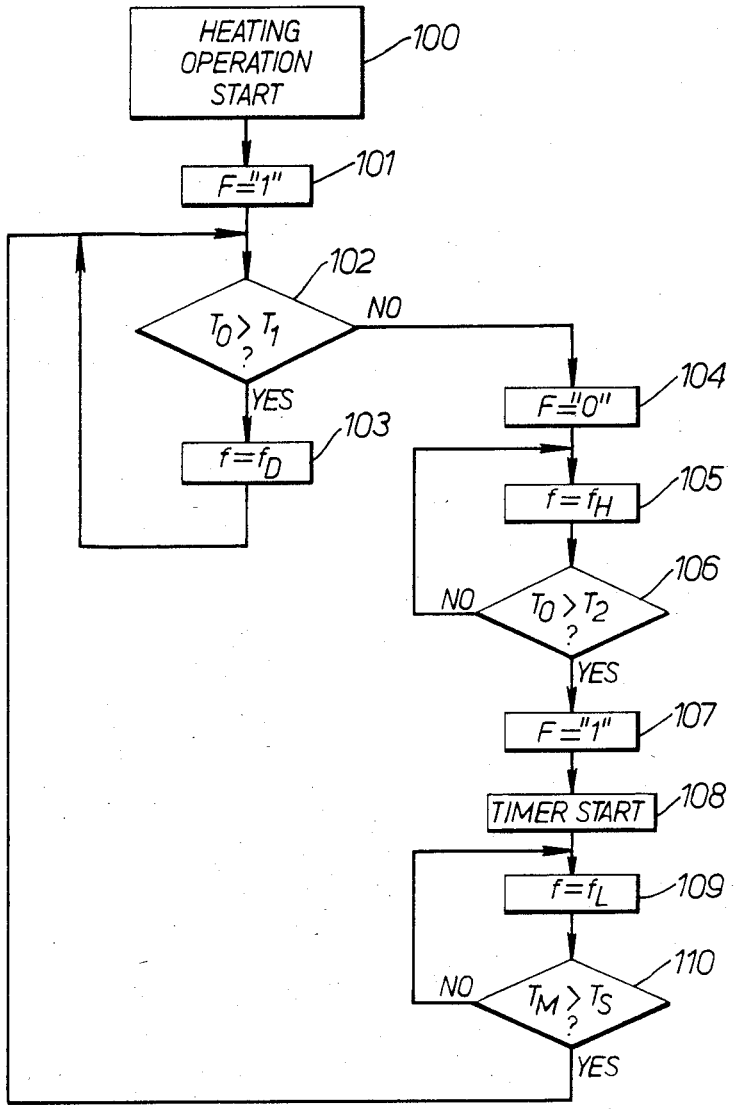
FIG. 3 is a flowchart illustrating operation for one embodiment of the invention.

Referring now to FIG. 3, a flow chart of the outdoor control system is illustrated. The start of the heating operation is initiated at block 100 by application of the heating mode signal from the mode switch 11 to the indoor control unit 14. Block 101 indicates application of a logic "1" signal F from the comparing unit 23 to four way valve relay 27. In this manner of operation, the refrigeration cycle enters the heating cycle and heats the room air. In block 102, outdoor heat exchanger temperature value $T_0$ is compared with the first temperature set value $T_1$, and if the value $T_0$ is higher than the value $T_1$, control passes to the block 103. In Block 103, the inverter 30 is controlled so that the output of the inverter 30 becomes the request frequency $f_D$ of the indoor control unit 14. Accordingly, the outdoor control system 20 causes the inverter 30 to generate the frequency requested by the indoor control system 20. If the value $T_0$ is lower than the value $T_1$, control passes to block 104 which provides an F=logic "0" signal which does not operate on the four way valve relay 27. In this manner of operation, the refrigeration cycle changes to the defrosting cycle.

During the defrosting mode of operation, the outdoor control system 20 causes the inverter 30 to generate high frequency $f_H$, as shown schematically by block 105. The inverter 30 then drives the compressor motor (not shown) at a high speed. Therefore the defrosting time is shortened. In block 106, the outdoor heat exchanger temperature $T_0$ is compared with the second temperature value $T_2$. If the value $T_0$ is lower than the value $T_2$, the defrosting mode continues and, the inverter continuously generates high frequency $f_H$ (block 105). If the value $T_0$ is higher than the value $T_2$, control passes to block 107 which provides an F=logic "1" signal which operates on the four way valve 2 via the four way valve relay 27. By this operation, the refrigeration cycle changes from the defrosting cycle to the heating cycle, and the heating mode of operation recommences. Then, operation passes to block 108, at which time the apparatus starts to count time TM. During counting of the time TM, operation is in block 109 during which the inverter 30 generates the predetermined low frequency $f_L$. In block 110, the counted time value TM is compared with the preset time value TS, and if TM is determined to be less than TS, the low frequency $f_L$ is maintained set as the output frequency of the inverter 30. Stated differently, if the counted time value TM is smaller than the preset time value TS, the inverter 30 continuously generates the low frequency $f_L$ by means of block 109. If the counting time value TM is larger than the preset time value TS, the outdoor control system 20 requests that the frequency of the indoor unit be based on the frequency setting signal D applied to the inverter 30 by the indoor control unit 14. Accordingly, the inverter 30 generates the predetermined low frequency $f_L$ which is supplied to the compressor motor during the time TS, during which the compressor 1 is rotated at low speed. After the time TS passes, the rotational speed of the compressor 1 is changed in accordance with the request of the indoor unit 14.

As there has been described about the manner of the defrosting by the changing of the four way valve position, this invention is able to be applied to other forms and implementations of hot gaseous refrigerant defrosting.

As above described, according to this invention, since the variable capacity compressor is controlled to be set at a low capacity when the heating cycle begins after defrosting, it is possible to prevent quantities of liquid refrigerant in the outdoor heat exchanger from flowing into the compressor, and thereby preventing refrigerant from dissolving into the lubricant of the compressor. Moreover, as this invention employs a defrosting mode in which the outdoor heat exchanger is rapidly defrosted by high capacity operation of the compressor, it is effective to avoid compressor lock.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A heat pump type air conditioning apparatus comprising;

a variable capacity compressor;

a reversing valve;

an indoor heat exchanger;

an expansion device;

an outdoor heat exchanger;

said compressor, said valve, said indoor heat exchanger, said expansion device and said outdoor heat exchanger connected respectively in series, and forming a closed refrigerant circuit operable in a defrost mode of operation wherein heat energy is transferred from said refrigerant to said outdoor heat exchanger;

detecting means for generating an electrical signal when the defrosting mode of operation is completed and the heating mode of operation begins; and protecting means for controlling said compressor so that said compressor is operated at a predetermined low capacity for a predetermined time interval upon receiving said electrical signal.

2. A heat pump type air conditioning apparatus according to claim 1, comprising:

an inverter for driving said compressor.

3. A heat pump type air conditioning apparatus according to claim 2, wherein said inverter comprises:

means for generating a signal having a frequency variable in accordance with the load of said heat type air conditioning apparatus.

4. A heat pump type air conditioning apparatus according to claim 1, wherein said detecting means comprises:

a thermal sensing element for sensing the temperature of said outdoor exchanger.

5. A heat pump type air conditioning apparatus as in claim 1, comprising:

means for changing operation from a heating cycle to a cooling cycle.

* * * * *